US012540785B2

(12) United States Patent
Krupnik et al.

(10) Patent No.: US 12,540,785 B2
(45) Date of Patent: Feb. 3, 2026

(54) SYSTEMS AND METHODS FOR RESTRICTING A FIREARM TO LESS LETHAL SHOOTING

(71) Applicant: SMART SHOOTER LTD, Yagur (IL)

(72) Inventors: Hagai Krupnik, Nofit (IL); Avshalom Ehrlich, Ramat Hashofet (IL); Yevgeni Megel, Haifa (IL); Shir Ahuvia Pick, Haifa (IL)

(73) Assignee: SMART SHOOTER LTD, Yagur (IL)

( * ) Notice: Subject to any disclaimer, the term of this patent is extended or adjusted under 35 U.S.C. 154(b) by 36 days.

(21) Appl. No.: 18/836,502

(22) PCT Filed: Feb. 7, 2023

(86) PCT No.: PCT/IL2023/050131
§ 371 (c)(1),
(2) Date: Aug. 7, 2024

(87) PCT Pub. No.: WO2023/152737
PCT Pub. Date: Aug. 17, 2023

(65) Prior Publication Data

US 2025/0155212 A1 May 15, 2025

(30) Foreign Application Priority Data

Feb. 8, 2022 (IL) ..... 290443

(51) Int. Cl.
*F41A 17/08* (2006.01)
*F41G 3/06* (2006.01)
*F41G 3/08* (2006.01)

(52) U.S. Cl.
CPC ..... *F41A 17/08* (2013.01); *F41G 3/06* (2013.01); *F41G 3/08* (2013.01)

(58) Field of Classification Search
CPC ..... F41A 17/08; F41G 3/06; F41G 3/08
(Continued)

(56) References Cited

U.S. PATENT DOCUMENTS 10,097,764 B2 10/2018 Ehrlich
10,739,109 B1 * 8/2020 Tello ..... F41G 3/08
(Continued)

FOREIGN PATENT DOCUMENTS

EP 1454111 B1 9/2004
EP 3155357 B1 2/2019
(Continued)

OTHER PUBLICATIONS

International Search Report and Written Opinion received in corresponding Application No. PCT/IL2023/050131, dated May 14, 2023, 7 pages.

*Primary Examiner* — Samir Abdosh
(74) *Attorney, Agent, or Firm* — Dority & Manning, PA

(57) ABSTRACT

A system for restricting a firearm to less lethal shooting includes an image sensor, at least one non-transitory memory storing instructions, and at least one processor that executes the instructions to cause the performance of the following steps: processing images to detect potential targets within a scene; locking onto and tracking at least one of the potential targets; defining a safety line relative to the scene; defining one or more aiming regions on the at least one locked-on target below the safety line; and controlling discharge of the firearm, so as to permit discharge of the firearm when a projectile discharged from the firearm will impact the scene or the target at one of the defined aiming regions, and to prevent discharge of the firearm when a projectile discharged from the firearm will impact the scene or target outside one of the aiming regions.

25 Claims, 7 Drawing Sheets

(58) Field of Classification Search
USPC ..... 42/70.01
See application file for complete search history.

(56) References Cited

U.S. PATENT DOCUMENTS

| | | | | |
|---|---|---|---|---|
| 2019/0137219 | A1* | 5/2019 | Bockmon | F41G 5/16 |
| 2019/0271516 | A1 | 9/2019 | Emas | |
| 2020/0166309 | A1 | 5/2020 | Panas | |
| 2021/0131758 | A1 | 5/2021 | Kenney et al. | |
| 2021/0131765 | A1 | 5/2021 | Beckman | |
| 2021/0140733 | A1 | 5/2021 | Herskowitz et al. | |
| 2021/0389088 | A1 | 12/2021 | Billbrey et al. | |
| 2021/0389093 | A1 | 12/2021 | Bilbrey et al. | |
| 2023/0036272 | A1* | 2/2023 | Campbell | F41G 3/08 |

FOREIGN PATENT DOCUMENTS

| | | | | |
|---|---|---|---|---|
| WO | WO 2021/048307 | | 3/2021 | |
| WO | WO-2021136974 | A1 * | 7/2021 | F41J 5/14 |
| WO | WO-2025054659 | A1 * | 3/2025 | F41G 11/00 |

* cited by examiner

SYSTEMS AND METHODS FOR RESTRICTING A FIREARM TO LESS LETHAL SHOOTING

CROSS-REFERENCE TO RELATED APPLICATIONS

This application is the U.S. National Stage entry of International Application No. PCT/IL2023/050131, filed on Feb. 7, 2023, which, in turn, claims priority to Israeli Patent Application No. 290443, filed on Feb. 8, 2022, both of which are hereby incorporated herein by reference in their entireties for all purposes.

FIELD OF THE INVENTION

The present disclosure, in some embodiments, concerns systems and methods for restricting a firearm to less lethal shooting, and more specifically, but not exclusively, to a system configured to define a safety line and a firing region on a target under the safety line, and to ensure that the firearm will impact the target within the firing region under the safety line.

BACKGROUND OF THE INVENTION

In crowd control scenarios, the objective of law enforcement officials is usually to incapacitate crowd members, without seriously injuring them. One common method for incapacitation is the use of "less lethal" ammunition. Examples of "less lethal ammunition" include kinetic impact projectiles, also known as baton rounds. These projectiles may be of small or big calibres (for example 40 mm), made of rubber, foam, plastic, certain types of metal, or any combination thereof. Theoretically, less lethal ammunition incapacitates the target without causing death or permanent injury.

In practice, however, when kinetic force is used to incapacitate a target, the impact may cause severe consequences, regardless of the type of ammunition used. This is particularly true when the ammunition is directed at sensitive regions of the body such as the head or chest. For this reason, in addition to using less lethal ammunition, law enforcement officers performing crowd control try to aim at less-critical portions of the body, such as the lower leg. However, in real-life scenarios, due to unforeseen circumstances and human error, which may be caused by stress or low level of skill, less lethal projectiles may nevertheless impact critical portions of the body.

Recently, systems have been proposed with the capability of identifying particular body parts. These systems suggest performing object recognition on a target or a region, using techniques including artificial intelligence, confidence-matching, and pose estimation. However, such systems require a significant amount of computing power, which is challenging to implement on a handheld firearm, with respect to weight, cost, and energy consumption of the system.

SUMMARY OF THE INVENTION

Accordingly, there exists a need for a system and method for restricting a firearm to less lethal shooting, without identification of particular body parts as a mandatory requirement. There further exists a need for a system and method for restricting a firearm to less lethal shooting that are able to adapt to changes in circumstances, such as movement of the target or approach or a new person toward the vicinity of the target.

According to a first aspect, a system for restricting a firearm to less lethal shooting is disclosed. The system includes an image sensor, at least one non-transitory memory storing instructions, and at least one processor that executes the instructions to cause the performance of the following steps: processing images received by the image sensor to detect one or more potential targets within a scene; locking onto and tracking at least one of the potential targets; defining a safety line relative to the scene; defining one or more aiming regions on the at least one locked-on target below the safety line; and controlling discharge of the firearm, so as to permit discharge of the firearm when a projectile discharged from the firearm will impact the scene or the target at one of the aiming regions, and to prevent discharge of the firearm when a projectile discharged from the firearm will impact the scene or target outside one of the defined aiming regions. Advantageously, the use of the safety line to restrict the firing of the firearm enables the system to restrict firing even without recognition of specific body parts of the target.

In another implementation according to the first aspect, the processor defines the safety line as a horizontal line relative to the scene. The horizontal line is technically straightforward to set, and enables the safety line to operate even without specific identification of the parts of the target that are above or below the line.

In another implementation according to the first aspect, the processor is configured to define the safety line automatically during or following locking onto the at least one target.

Optionally, the processor defines the safety line at or below a predefined percentage of the height of the at least one locked-on target relative to a total height of the at least one locked-on target. The predefined percentage may be set based on a typical height of non-life-dependent body parts of a target.

In another implementation according to the first aspect, the predefined percentage is set according to a type of ammunition that is to be fired on the at least one locked-on target. For example, the percentage may be higher for rubber bullets than it is for conventional bullets.

In another implementation according to the first aspect, the processor is further configured to identify one or more body parts of the at least one locked-on target, and to define the safety line so as to permit impact only on certain identified body parts. For example, the identified body parts may be a part of a leg.

In another implementation according to the first aspect, the processor is configured to define the safety line according to a user command. Optionally, the user command is a selection of a height relative to the scene; and the processor is configured to define the safety line as a lower of (1) the selected height and (2) a predefined percentage of the height of the at least one locked-on target relative to a total height of the at least one locked-on target. Advantageously, the user has the ability to define the safety line in a manner that is even more stringent than the preset percentage of the height. Optionally, when the selected height is below the at least one locked-on target, a projectile discharged from the firearm is allowed to impact the scene only in front of the at least one locked-on target. The user is thus able to define the safety line so that any projectile fired by the user will not hit any target at all, and will serve only as a warning shot.

In another implementation according to the first aspect, when the processor detects an approach of the at least one locked-on target to the firearm, the processor lowers the safety line relative to the scene, while maintaining the safety line at a same height on the at least one target. Advantageously, the automatic lowering of the safety line ensures that the target will be hit below the safety line, regardless of how the target moves.

In another implementation according to the first aspect, the processor is configured to define the one or more aiming regions taking into account the size and shape of the target, the ballistics of the firearm, wind speed, moving speed of the at least one target, and range to the target. Consideration of these inputs reduces the likelihood of missed shots.

Optionally, following locking onto the at least one target, the processor is further configured to prevent discharge of the firearm upon detection of entry of a non-target or another of the one or more potential targets into the one or more aiming regions. This automatic blocking of the firing further prevents accidental fatal shooting, in particular of the additional potential target.

In another implementation according to the first aspect, the processor is further configured to detect a range to the locked-on target and to prevent a discharge of the firearm within a predetermined distance of the locked-on target. This functionality prevents unintended fatal shooting caused by point-blank impact, regardless of the type of ammunition.

In another implementation according to the first aspect, the system further includes the firearm. The firearm is either handheld, or part of a weapon system installed on a remote-controlled weapon station, a robot, or a drone.

According to a second aspect, a method of restricting a firearm to less lethal shooting is disclosed. The method includes: processing images received by an image sensor to detect one or more potential targets within a scene; locking onto and tracking at least one of said potential targets; defining a safety line relative to the scene; defining one or more aiming regions on the at least one locked-on target below the safety line; and controlling discharge of the firearm, so as to permit discharge of the firearm when a projectile discharged from the firearm will impact the scene or the target at one of the defined aiming regions, and to prevent discharge of the firearm when a projectile discharged from the firearm will impact the target outside one of the defined aiming regions.

In another implementation according to the second aspect, the method further includes defining the safety line as a horizontal line relative to the scene.

In another implementation according to the second aspect, the method further includes defining the safety line automatically during or following locking onto the at least one target.

Optionally, the method further includes defining the safety line at a predefined percentage of the height of the at least one locked-on target relative to a total height of the at least one locked-on target.

Optionally, the method further includes setting the predefined percentage according to a type of ammunition that is to be fired on the at least one locked-on target.

In another implementation according to the second aspect, the method further includes identifying one or more body parts of the at least one locked-on target, and defining the safety line so as to permit impact only on certain identified body parts.

In another implementation according to the second aspect, the method further includes defining the safety line according to a user command. Optionally, the user command is a selection of a height relative to the scene; and the step of defining the safety line comprises defining the safety line as a lower of (1) the selected height and (2) a predefined percentage of the height of the at least one locked-on target relative to a total height of the at least one locked-on target. Optionally, when the selected height is below the at least one locked-on target, a projectile discharged from the firearm is allowed to impact the scene only in front of the at least one locked-on target.

Optionally, the method further includes, upon detection of an approach of the at least one locked-on target to the firearm, lowering the safety line relative to the scene while maintaining the safety line at a same height on the at least one locked-on target.

In another implementation according to the second aspect, the step of defining the one or more aiming regions is performed taking into account the size and shape of the target, the ballistics of the firearm, wind speed, moving speed of the at least one target, and range to the target.

Optionally, the method further includes, further comprising, following locking onto the at least one target, preventing discharge of the firearm upon detection of entry of a non-target or another of the one or more potential targets into the one or more aiming regions.

In another implementation according to the second aspect, the method further includes detecting a range to the at least one locked-on target and preventing discharge of the firearm within a predetermined distance from the at least one locked-on target.

DETAILED DESCRIPTION OF THE INVENTION

Figure 1A:
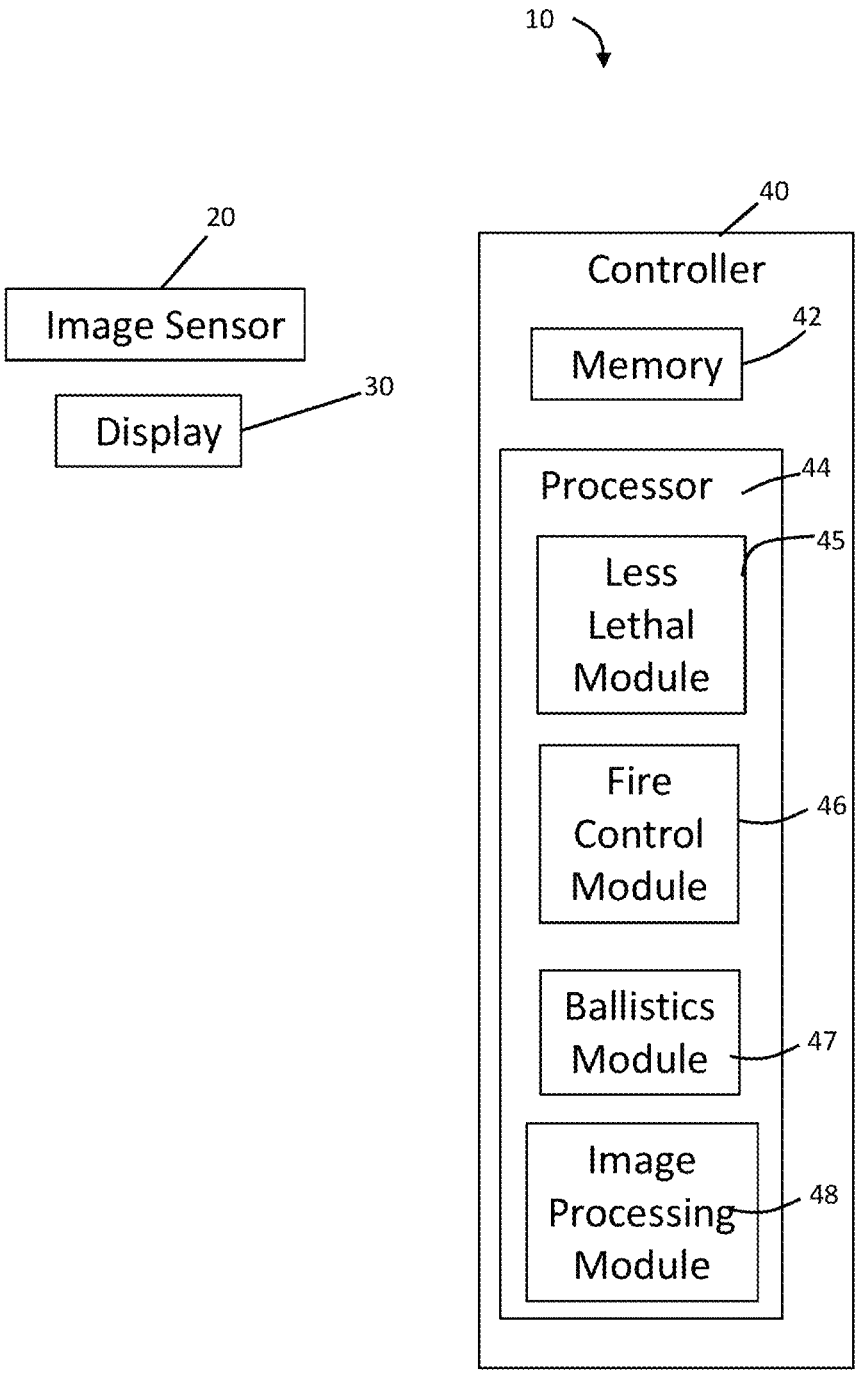
FIG. 1A is a schematic block diagram illustrating functional components of the system for restricting the firearm to less lethal firing, according to embodiments of the present disclosure.

The present disclosure, in some embodiments, concerns systems and methods for restricting a firearm to less lethal shooting, and more specifically, but not exclusively, to a system configured to define a safety line and a firing region on a target under the safety line, and to ensure that the firearm will impact the target within the firing region under the safety line.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

FIG. 1A schematically depicts components of a system 10 for limiting a firearm to less lethal firing. System 10 includes image sensor 20, display 30, and controller 40.

Image sensor 20 may be a day/night video camera, for example a charge-coupled device (CCD) or CMOS; forward looking infra-red sensor (FLIR); multispectral or hyperspectral camera, or any other sensor that enables detection and tracking of a target location in its field of view (FOV) including combinations thereof. In this regard, the image sensor 20 may "fuse" data from more than one sensor into one or more representations or use different inputs in parallel. Image sensor 20 may be capable of imaging in the visual and/or infrared ranges. As will be discussed further herein, the image sensor is used to obtain images of a scene, from which targets are identified.

In addition to the image sensor 20, the system 10 may include other sensors that may be used to detect and track targets. These additional sensors may include, for example, an inertial measuring unit (IMU), an accelerometer/inertial sensor; a compass; a GPS, and a Laser Range Finder (LRF).

Display 30 may be any hardware component that displays an image toward an eye of the user of the firearm. The display 30 may be a microdisplay configured on the firearm itself, or may be a display external to the firearm, such as a weapons station controller or augmented reality goggles. When the display 30 is a microdisplay, the microdisplay either displays images superimposed on a real-world view, or a video feed obtained by image sensor 20. The display 30 is used to project a safety line onto a view of the scene in which a target is present, as will be discussed further herein.

Controller 40 includes a non-transitory computer-readable memory 42 for storing instructions, and a processor 44 configured to execute the instructions. The processor 44 includes various modules for performance of certain activities. In particular, in exemplary embodiments, processor 44 includes a less lethal firing module 45, a fire control module 46, a ballistics module 47, and an image processing module 48.

Less lethal firing module 45 is used to define a safety line. When the less-lethal firing mode is in effect, the less-lethal firing module 45 prevents the firearm from firing at targets at or above the safety line, as will be described at length further herein. The less-lethal mode of operation may be the only mode, or an alternative mode of operation to the standard combat modes. These standard modes may include a manual shooting mode, without any intervention, and a fire control system mode, whose operation is described immediately below.

Fire control module 46 controls operation of a fire control system. As used in the present disclosure, the term "fire control system" refers to a system that controls when a firearm is discharged. Such a system detects and locks onto a target and tracks the point of aim of the firearm relative to the target. Once the target is acquired and locked onto, the system waits for the firearm to be correctly oriented and positioned (for example, in direction or elevation) before allowing the firearm to discharge. In exemplary embodiments, even when a user holds down the trigger, the weapon will only discharge when the weapon is pointing in the right direction. The fire control system takes into account not only the relative position of the firearm to the target, but also factors such as speed of the target, distance, slope (ballistics), roll, wind, air pressure, and involuntary movement of the firearm caused by the user.

In exemplary embodiments, the fire control module 46 defines one or more specific aiming regions. When used outside the context of less lethal firing, if the target is a human, the aiming region may be defined as the human's chest. In the context of less lethal firing, the aiming region may be selected as a portion of the target's body below the safety line. The aiming region is an optimal aim point that is calculated in view of ballistics, wind, and other environmental factors. The fire control module 46 may also include a fire timing module that determines when to allow a bullet discharge in order to maximize a likelihood of impacting the target, calculated using the relative position between a point of aim of the firearm and the aiming region.

The operation of the fire control system may be substantially similar to that described in U.S. Pat. No. 10,097,764, entitled "Firearm, Aiming System Therefor, Method of Operating the Firearm and Method of Reducing the Probability of Missing a Target," and Israeli patent application No. 281842, filed Mar. 25, 2021, entitled "Telescopic Rifle Sight", each of which is assigned to the assignee of the pending application, and the contents of which are incorporated by reference as if fully set forth herein.

Ballistics module 47 contributes to the calculations of the fire control module 46 by enabling adaptation to the particular ballistics and ammunition used in the firearm. In particular, the processor 44 may be configured to time the firing differently based on different types of ammunition and ballistics parameters.

Image processing module 48 is used to analyze images obtained by the image sensor 20, in order to identify the one or more potential targets which move relative to the scene. Information from the image processing module 48 is further used in the defining of the safety line by the less lethal firing module 45 and the aiming region by the fire control module 46.

The firearm may include various other modes of operation as well, including a zeroing mode, a marksmanship training mode, or an autonomous operation (drone) mode.

Figure 1B:
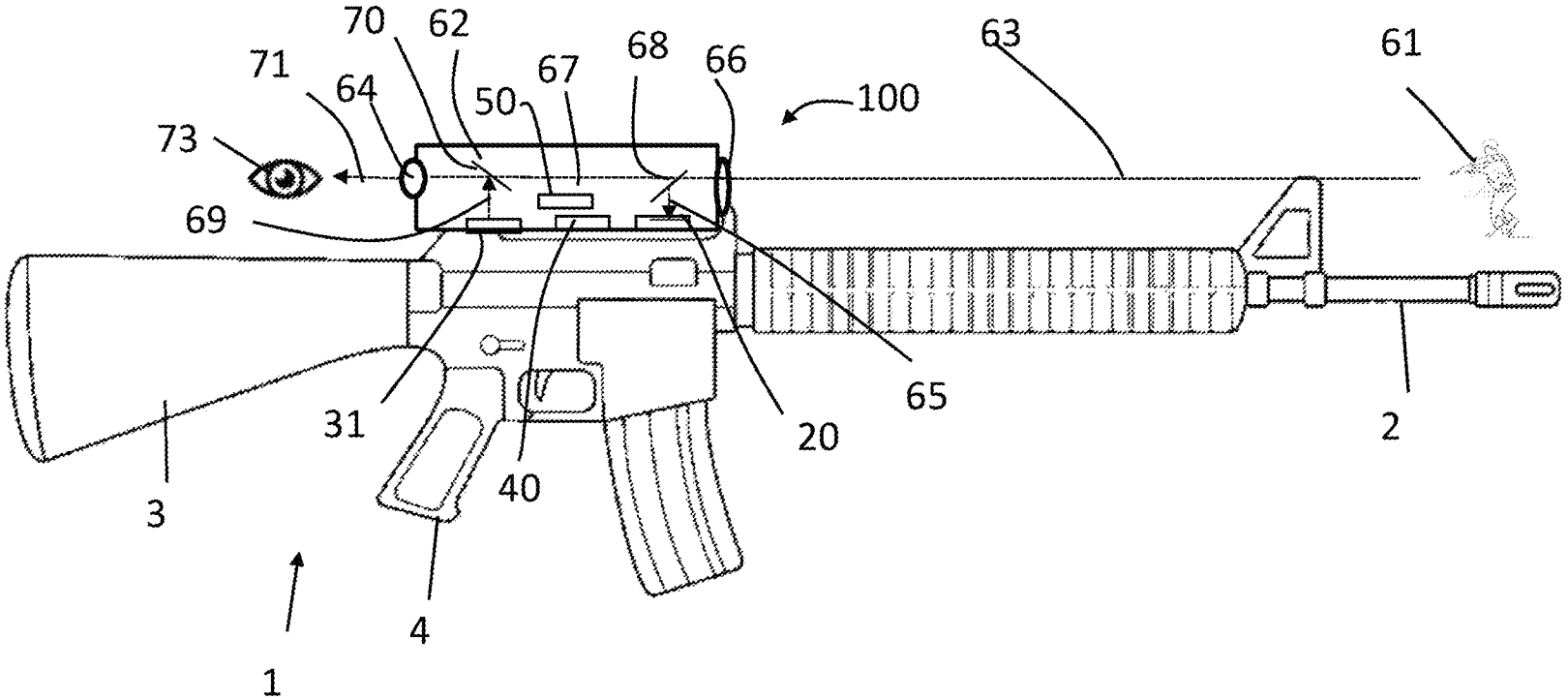
FIG. 1B schematically illustrates arrangement of the system of FIG. 1A on a firearm, according to embodiments of the present disclosure.

FIG. 1B schematically depicts a hardware device 100, suitable for implementing system 10, installed on a firearm 1. In the illustrated embodiment, firearm 1 is a handheld rifle. However, device 100 may be incorporated on any device for shooting ammunition that is known to those of skill in the art, including a pistol, a handgun, a shotgun, a machine gun, a carbine, a revolver, a grenade launcher, a rocket launcher, a remote controlled weapon station, a robot, or a drone. Firearm 1 may use any type of bullets, whether less lethal ammunition (e.g., rubber, or foam), as well as standard combat ammunition (5.56 mm, 7.62 mm, etc.).

Device 100 is affixed onto firearm 1, and generally aligned with bore 2 of the firearm. Bore 2 is also known as a barrel. Device 100 includes housing 62, which may be made of any suitable material.

FIG. 1B depicts one exemplary optical system for displaying a view to a user of the firearm, as will be explicated immediately below. As those of skill in the art would recognize, there are numerous such display systems that would be consistent with the system 100 whose capabilities are described herein. For example, device 100 may include an image sensor and a processor, and may cast a display to an eyepiece that is near the user's eye. Likewise, the display may be cast to any suitable screen, whether close or far to the image sensor 20.

Ocular 64 is arranged at the rear of device 100, closer to the stock 3 and grip 4 of the firearm 1. Ocular 64 may be an arrangement of optical lenses. Ocular 64 is also referred to herein as an optical window. Objective lens 66 is arranged at the front of device 100, closer to the barrel 2 of the firearm 1. Objective lens 66 is also referred to herein as a lens assembly. Objective lens 66 is depicted schematically as a single lens; however, objective lens 66 may consist of multiple lenses. Objective lens 66 may be adjustable, to enable focusing and/or zooming of the device 100 on targets at different distances from the shooter. Optionally, objective lens 66 includes one or more filters or apertures that may be adjusted by the user, or an adjustable focus control, in order to change the focus of objective lens 66.

Device 100 may optionally include additional lens assemblies within housing 2, in addition to ocular 64 and objective 66. These additional lenses may also be used for adjusting the focus of the view of the smart aiming device 100.

Device 100 includes a beam splitter 68. Beam splitter 68 may be constructed in any manner that is known to those of skill in the art. For example, beam splitter 68 may be made of two triangular glass prisms. Incident light reflected off of target 61 enters lens assembly 66 as light beam 63. When light beam 63 reaches beam splitter 68, the light beam 63 is split into light beam 65 and light beam 67.

Light beam 65 reaches image sensor 20. Image sensor 20 is used to capture an image of the target 61. The image sensor 20 is integrated with processor 40. Sensors 50 are schematically indicated as near the processor 40, and are integrated with the processor 40 as well.

Microdisplay 31 is also integrated with processor 40. Microdisplay 31 may project a digital reticle along light path 69. As used in the present disclosure, the term "digital reticle" refers to any electronically created image of a reticle. The digital reticle may be displayed in any shape or color, such as a circle or cross-hairs. Optionally, the microdisplay 31 is configured to change the shape of the display of the digital reticle according to commands from the fire control system, for example, depending on whether the firearm 1 is properly aimed at the target zone within the target. Beam splitter 70 refracts at least a portion of the light emitted by the microdisplay toward light path 71. Light path 71 thus includes both light from the lens assembly 66 and light from microdisplay 60, combined into a single view. User 73 views the light through optical window 64. Accordingly, the user 73 sees an image of the digital reticle superimposed over an image of the target 61.

In addition, in the functioning of both the less lethal firing module 45 and the fire control module 46, microdisplay 31 displays boundaries of a target region. These boundaries may be projected to overlay the image of the target that is viewed by the user through ocular 64, similarly to the projection of the reticle. In addition, the microdisplay 31 may project the entire scene that is captured by image sensor 20. This is especially useful at times of low visibility, such as at night, when the naked eye is unable to discern significant details in a landscape. Because the image sensor 20 may be far more sensitive than the human eye, especially in the near-infrared range, the image projected by the microdisplay 31 may be much more useful than the image obtained directly from ocular 76. In order to prevent interference of the view with the image from the microdisplay 31, a mechanical shutter (not shown) may be configured to block light path 67, when desired.

Furthermore, in the functioning of the less lethal firing module 45, the microdisplay 31 may display other elements. Most notably, microdisplay 31 displays the safety line overlaid on the image of the target received from light beam 63. When microdisplay 31 displays a reproduction of the entire image captured by the image sensor 20, the microdisplay 31 superimposes the safety line over the reproduction.

It should be understood to those of skill in the art that the functions described herein in connection with microdisplay 31 may take place in any suitable display 30 that is integrated with system 10, as discussed above.

The foregoing description of the physical configuration of device 100 with firearm 1 is merely exemplary, and other implementations may be used, without departing from the scope of the present disclosure. For example, instead of a single optical path 71 for light coming from lens assembly 66 and light coming from microdisplay 31, there may be two separate optical paths. In addition, instead of two beam splitters 68, 70, there may be only a single beam splitter.

Figure 2A:
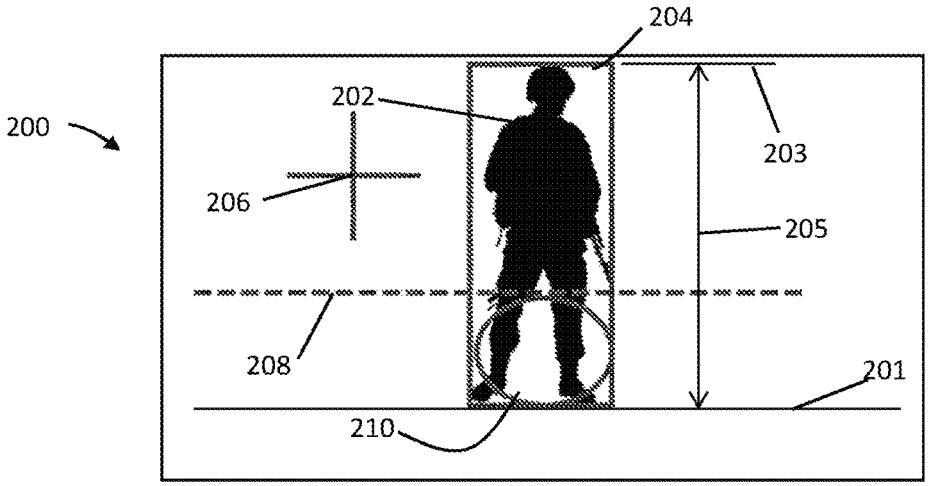
FIG. 2A illustrates placement of a safety line at a predefined percentage of height of an identified target, according to embodiments of the present disclosure.
Figure 2B:
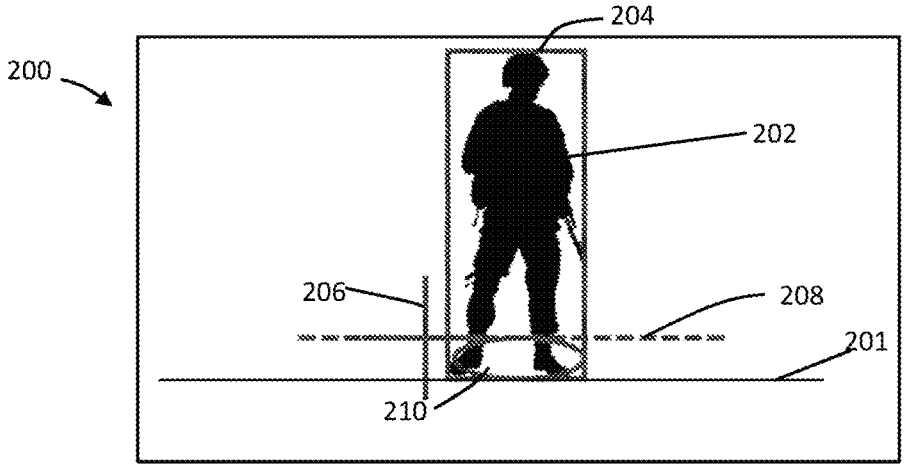
FIG. 2B illustrates manual placement of a safety line on an identified target, according to embodiments of the present disclosure.
Figure 2C:
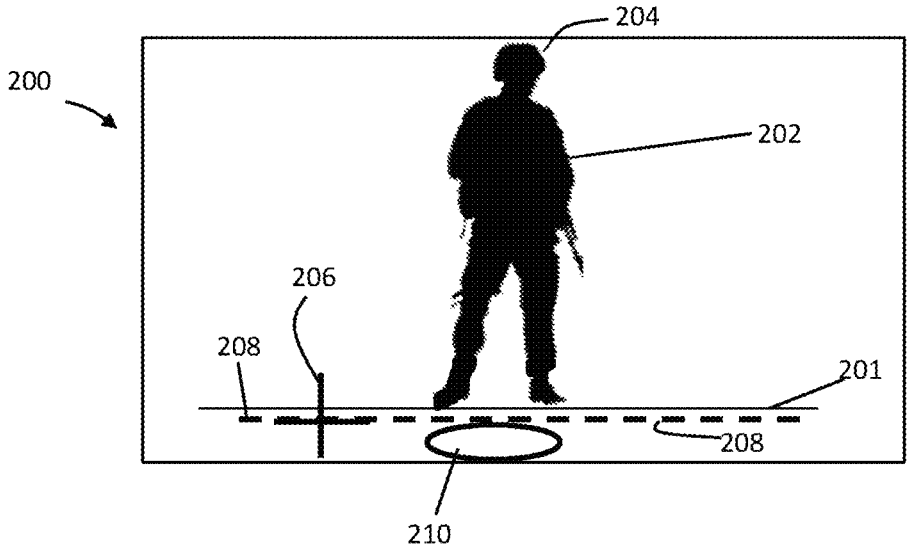
FIG. 2C illustrates manual placement of a safety line in front of an identified target, according to embodiments of the present disclosure.

Referring now to FIGS. 2A-2C, modes of implementing less lethal shooting system 10 are disclosed. The less lethal firing system 10 uses a safety line to limit where the firearm may be shot. Following establishment of the safety line, the fire control module 46 defines an aiming region that is below the safety line. In particular, less lethal firing system 10 permits discharge of the firearm when a projectile discharged from the firearm will impact a scene or a target at the aiming region, which is below the safety line. The system 10 prevents discharge of the firearm when the system 10 predicts that a projectile discharged from the firearm will impact the scene or target above the safety line or outside one of the defined aiming regions.

The concept of a safety line is predicated on the anatomical reality that the bodies of potential targets, including humans, include lower extremities for which impacts are rarely fatal. In other words, it is very unusual for a person to suffer life-threatening injuries due to a bullet impact to the foot or lower leg, especially when less lethal ammunition is used. In addition, in a crowd control situation, these lower extremities are almost always closer to the ground than the rest of the body (i.e., the target is standing, walking, or running, rather than crawling or performing a cartwheel).

As a result, once the vertical dimension of the target is identified, it is possible to define a horizontal safety line at approximately 30% of the target's height, and be assured that, so long as the target maintains a consistent posture, a projectile hitting the target will impact at the lower leg or foot.

Crucially, only two inputs are required in order to determine the height of safety line: the detection of a target within a scene, and the height of the identified target. These inputs may be determined solely based on analysis of sequential images of the scene. Specifically, the target may be detected within a scene based on the target's movements relative to fixed features in a scene (for example, trees or buildings in the background). Once the target is detected, the height of the target is calculated relative to the background. It is not necessary to identify any particular body part of the target in order to define the safety line. It is not even necessary for system 10 to identify that the target is human; the contours of the target may be established based on the target's movements, or other static detectors without a positive identification as to what type of object it is.

Referring to FIG. 2A, the safety line may be defined automatically during or following locking onto the target. The automatic determination may be based on a percentage of the height of the target. Box 200 represents the scene as displayed by microdisplay 31. The processor detects one or more potential targets 202 within scene 200. In the embodiment of FIG. 2A, only a single target 202 is in the scene 200. The user instructs the system 10 to lock onto a particular target 202, for example, by depressing a dedicated button on the side of device 100. Following locking onto the target 202, a bounding box 204 is defined around the target 202, and the system tracks the locked-on target within scene 200.

To determine the location of the safety line, the processor 40 identifies a lower bound 201 of the target and an upper bound 203 of the target, and calculates the height 205 of the target. On the basis of these inputs, the processor 40 defines the safety line 208 at a predetermined percentage of the height 205 of the target. In the illustrated embodiment, the safety line 208 crosses the target 202 approximately at knee level.

Digital reticle 206 represents the current aim point of the firearm. Alternatively, reticle 206 is a dedicated reticle for purposes of setting the safety line, and is not otherwise used during firing. Regardless, in the illustrated example, this point is above the predetermined height at which safety line 208 was set. As a result, the system 10 does not allow setting of the safety line 208 at the height of the digital reticle 206. Instead, the safety line 208 is placed according to the predetermined height percentage. Optionally, and especially when the digital reticle 206 is above the height of the safety line 208, the safety line 208 is defined automatically according to the predefined height percentage following locking onto the target 202.

The predetermined height percentage may be set by the user before the placement of the security line 208. In addition, different values for the predetermined percentage may be set according to a type of ammunition that is to be fired on the locked-on target 202. For example, the predetermined percentage may be set lower for standard bullets than for kinetic impact projectiles.

In addition to setting the bounding box 204 and the safety line 208, the system 10 may define one or more aiming regions 210 on the portion of the target 202 that is at or below the safety line 208. Following placement of the aiming region 210, the processor permits discharge of the firearm only when the processor predicts that a projectile discharged from the firearm will impact the target 202 in the aiming region 210. The processor defines the aiming region or regions 210 taking into account at least the size and shape of the target, ballistics of the firearm, wind speed, moving speed of the target, atmospheric pressure, and range to the target. Taking these factors into account helps ensure that changes in different ballistic parameters will not cause a hit in an undesired region, or a miss.

Although, in the illustrated embodiments, the aiming regions 210 take the shape of an ellipse, this depiction is merely for illustration, and the aiming region 210 may take any geometric shape. In addition, aiming region 210 may take a more complex shape as well, such as a contour.

FIG. 2B depicts a second manner of setting the safety line 208, based on user command. In the view of FIG. 2B, the reticle 206 is below the predetermined height percentage. In such circumstances, the processor may define the safety line 208 at the height of the digital reticle 206, according to a user command received following locking onto the target 202, if desired. The selection of this height may be communicated to the processor using any standard methods, such as a button. Because this height is lower than the height of the predetermined percentage, the system accepts the user command and defines the safety line 208 accordingly.

In exemplary embodiments, a user may communicate a command to set the safety line. The user may communicate this command, for example, via depression of a dedicated button on the housing of the device 100. Upon receipt of a command to set the safety line, the processor is configured to define the safety line as a lower of (1) the selected height and (2) the predefined percentage of the height of the at least one locked-on target relative to a total height of the at least one locked-on target. In FIG. 2A, the lower of the two is the predefined percentage, whereas in FIG. 2B, the lower of the two is the selected height.

FIG. 2C addresses a special case of the embodiment of FIG. 2B, in which the user has placed the reticle 206 at a height that is completely below the height of target 202. The result is that a projectile discharged from the firearm is allowed to impact the scene only in front of the target 202, and will not hit the target 202 at all. This may be desirable for cases where a warning shot is desired without hitting the target itself.

Notably, although the height of the target 202 may be used as an input for purposes of defining the safety line 208, the safety line 208 is defined relative to the scene 200. Thus, the processor will prevent firing of the firearm higher than the safety line 208 at any location in the scene 200, even at a point that would not impact the target 202.

To remove the safety line, the user may depress the dedicated button that was used to engage the safety line. Following removal of the safety line, the firearm is able to operate again in its lethal mode, if such a mode exists in its system, until a subsequent setting of a safety line.

Figures 3A, 3B, 3C:
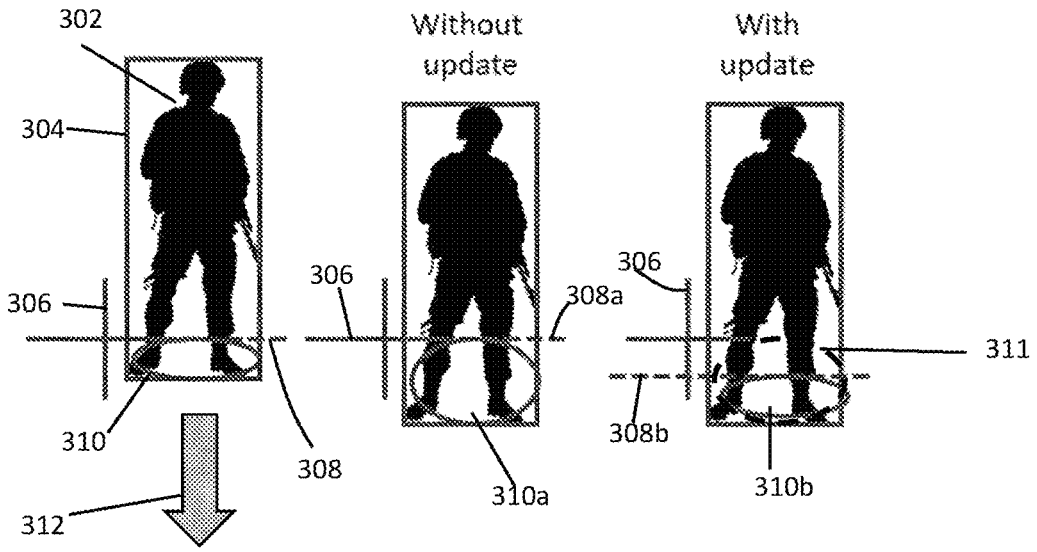
FIGS. 3A-3C illustrate an effect on the placement of the safety line when a target moves toward the firearm, according to embodiments of the present disclosure.

FIGS. 3A-3C address the effect on the safety line when the target moves closer to the firearm, or vice versa. In general, once the position of the safety line is determined, its position is constantly updated to compensate to the movement of the system and the sensor.

In FIG. 3A, target 302 is depicted with bounding box 304, reticle 306, safety line 308, and aiming region 310. The target 302 approaches the firearm, as indicated by arrow 312.

Referring to FIG. 3B, if the safety line 308*a* were to remain in the same place relative to the scene, the effect would be raising the height of the safety line 308*a* relative to the target 302. This is because the approach of the target 302 to the image sensor effectively causes the target to descend within the frame. Correspondingly, the aiming region 310*a* would encompass a higher portion of the body of the target.

As shown in FIG. 3C, in order to prevent this from happening, when the target 302 approaches the image sensor, the system 10 automatically lowers the safety line 308*b*. As a result, the safety line 308*b* and the corresponding aiming region 310*b* are located at the same height relative to the target 302 as in the view of FIG. 3A. This movement of the safety line 308*b* occurs despite a lack of corresponding movement in reticle 306, which remains in the same location as in the previous views.

Notably, the contours of aiming region 310 may update in response to a change in the size, shape, or movement of the target 202, regardless of whether the safety line 308 is engaged. This updating may also occur regardless of whether, before or after the movement, the aiming region 310 is encompassed in whole or in part within the area under the safety line 308. This update of the aiming region 310 is performed by the image processing module 48 and ballistics module 47. In situations such as that illustrated in FIG. 3C, a theoretical aiming region 311 may be defined in addition to aiming region 310*b*. Aiming region 310*b* is of smaller dimension than the theoretical aiming region 311 that is calculated in response to the movement of the target 302. Optionally, once the safety line 308 has been lowered, it may remain in the same location relative to the scene, even if the target subsequently retreats to its original position. The safety line 308 may remain fixed until it is removed and reset by the user. This prevents accidental restoration of the safety line in an area of a target likely to cause serious injury.

Figures 4A, 4B:
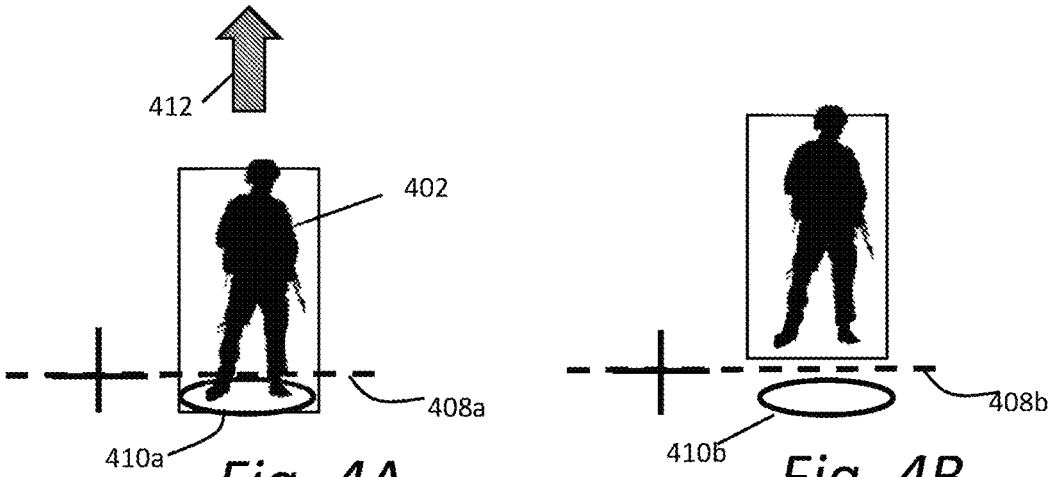
FIGS. 4A and 4B illustrate an effect on the placement of the safety line when a target moves away from the firearm, according to embodiments of the present disclosure.

FIGS. 4A and 4B depict the opposite scenario, in which the target 402 moves away from the image sensor. In such scenarios, when the processor detects a distancing of the target from the firearm, the processor maintains the safety line at the same height relative to the scene, thereby effectively lowering the safety line relative to the target. At FIG. 4A, the safety line 408*a* and ellipse 410*a* are set with respect to target 402. The target 402 moves away from the image sensor, as indicated by arrow 412. At FIG. 4B, the safety line 408*b* and ellipse 410*b* remain in the exact same location, even though the target has moved above the line.

Figure 5:
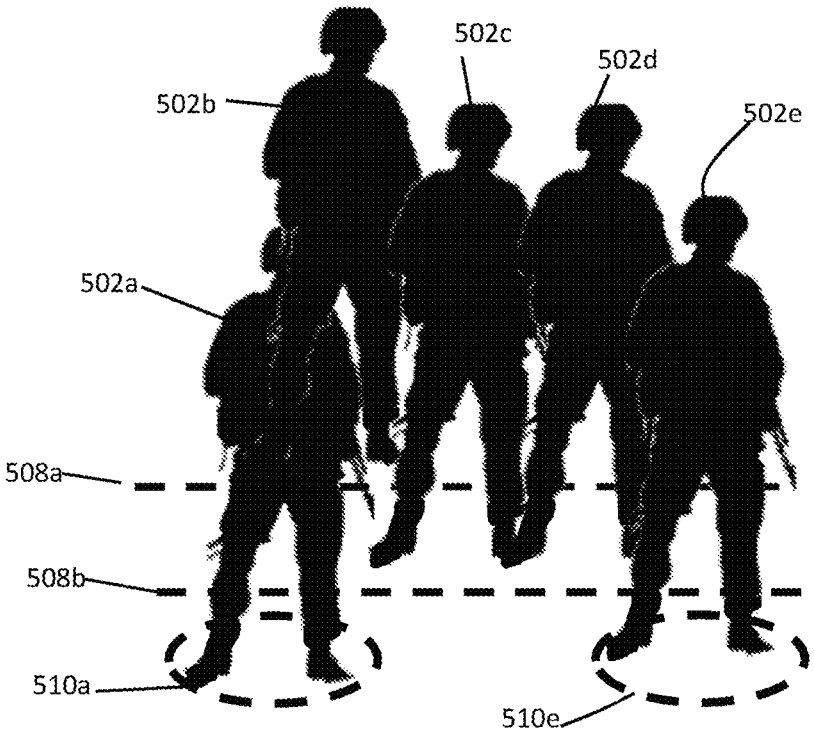
FIG. 5 illustrates placement of the safety line in a scene with more than one potential target, according to embodiments of the present disclosure.

FIG. 5 depicts a scenario in which a plurality of targets 502*a*, 502*b*, 502*c*, 502*d*, 502*e* are visible in a scene. In this scenario, the processor sets the safety line by calculating a predefined percentage of the combined height of the plurality of targets. Specifically, the system considers the group of targets as if it were a large, combined target, calculates the height of that combined target, and calculates the safety line based on the height of the entire group. This calculated safety line is indicated at line 508*a*. When there is a significant disparity in the heights of the different targets relative to the scene, this automatically calculated safety line 508*a* may relatively high in relation to the furthest forward targets (e.g., targets 502*a* and 502*e*). The user may compensate by manually setting a safety line 508*b* at a suitable height relative to these targets. Following setting of the safety line 508*b*, aiming regions 510*a* or 510*e* may be set below the safety line 508*b*.

Alternatively, it is possible to separate each of the targets 502*a-e*, to determine the height of each target separately relative to the scene, and to set the safety line automatically according to the placement of the lowest target.

Figure 6:
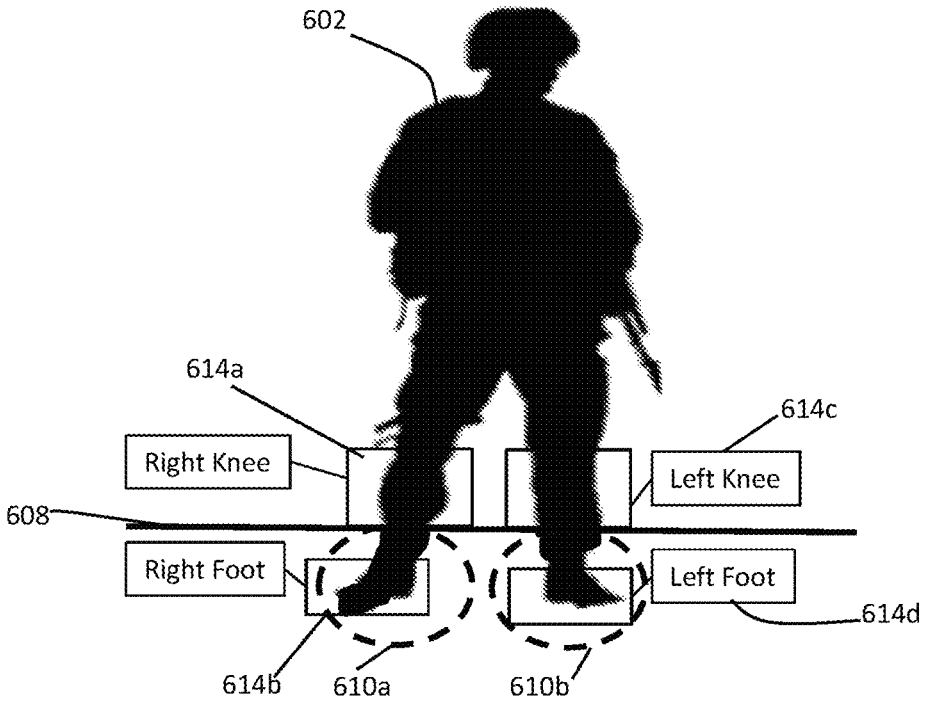
FIG. 6 illustrates placement of a safety line in conjunction with identification of particular body parts on a target, according to embodiments of the present disclosure.

FIG. 6 depicts another implementation of defining the safety line and aiming regions. In the embodiment of FIG. 6, prior to setting the safety line, the processor performs an image recognition process on an image of the target, and identifies particular body parts of the target. In this case, the processor defines region 614*a*, corresponding to the right knee; region 614*b*, for the right foot; region 614*c*, for the left knee, and region 614*d*, for the left foot. Optionally, the microdisplay displays bounding boxes and textual labels for each identified region, as indicated in the Figure. The user selects one or more body part to target, from among the identified body parts. The processor then defines the safety line so as to permit impact only on the identified body part or body parts. For example, in the depicted image, the user selects the right foot 614*c* and left foot 614*d*, and the processor sets the safety line 608 and ellipses 610*a* and 610*d* according to the user's selection. Alternatively, the identification of a target's body part may also occur following setting of the safety line.

In alternative embodiments, the safety line is defined relative to the scene and not connected to the act of locking onto a target. The defining of the safety line may occur even prior to entry of the target onto the scene. This functionality is particularly relevant in situations in which a firearm is fixed in a particular location. For example, at a weapons station or observation point, a firearm may be continuously aimed in a certain direction. Even before a target enters the scene, the safety line may be defined relative to the scene surrounding the weapons station. At this state, the firearm is ready to fire within a distance from the weapons station, but only below the safety line.

Figure 7:
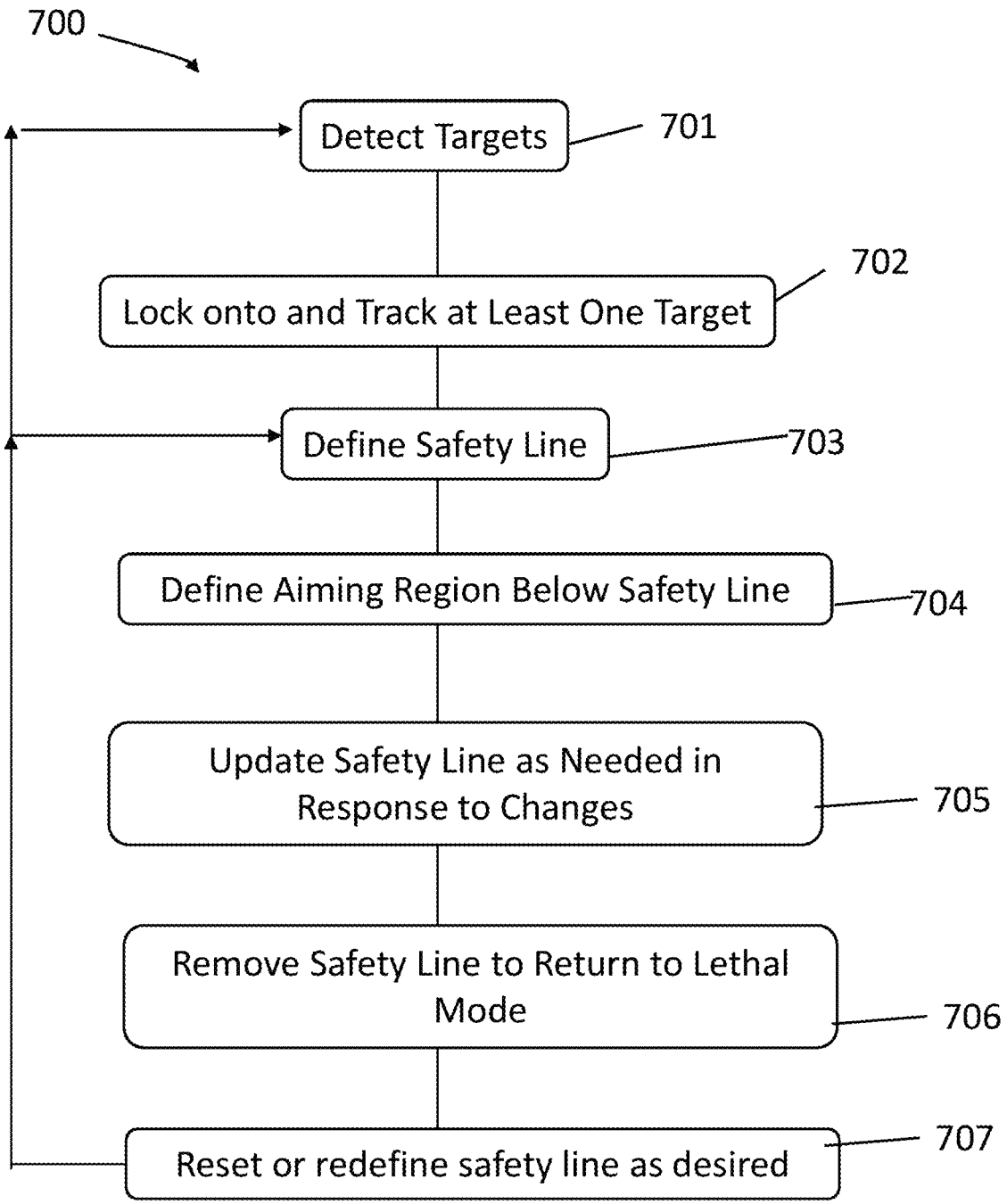
FIG. 7 illustrates steps of a method of controlling a firearm to permit only less lethal firing, according to embodiments of the present disclosure.

FIG. 7 illustrates steps of a method 700 of restricting a firearm to less lethal shooting, according to embodiments of the present disclosure. At step 701, the system detects targets within a scene, for example by detecting movement of the target relative to the scene, in the manner discussed above. At step 702, the system locks onto and tracks at least one target. As discussed above, typically, the locking onto the target is in response to a user input, and, following locking onto the target, the system tracks the target automatically. At step 703, the system defines a safety line relative to a scene and, optionally, displays the safety line on the microdisplay. As discussed above, it is possible for the safety line to be defined relative to the scene even prior to entry of a target onto the scene.

At step 704, the system defines an aiming region below the safety line. The system controls discharge of a firearm, so as to permit discharge of the firearm when a projectile discharged from the firearm will impact the scene or the target within the aiming region, and to prevent discharge of the firearm when a projectile discharged from the firearm will impact the target outside the aiming region. At step 705, the system updates the safety line as needed in response to changes, such as movement of the target toward the image sensor, as discussed above. At step 706, when the user wishes to return to using the firearm in regular or lethal mode, the user disengages the safety line. At 707, optionally, the user may reset or redefine the safety line in order to enter safety mode again. For example, the user may reset the same safety line that was previously set, without repeating any steps; or may define a new target (returning to step 701) or may define the safety line again with respect to the same target (returning to step 703). The user may then repeat the other steps as needed.

In addition to the above-described functions, the less lethal module 46 may include additional safety functionalities. For example, following locking onto a target, the processor may be configured to prevent discharge of the firearm upon detection of entry of a non-target (for example, a child or a dog) or another potential target into the aiming region or its vicinity. This prevents unintentional hitting of the new potential target in a lethal location.

In addition, the processor may be further configured to detect a range to the locked-on target, and to prevent discharge of the firearm within a predetermined distance from the locked-on target. Shooting at close range, even at a peripheral body part such as a foot, may cause serious injury, and prevention of shooting from such ranges limits the potential for such injuries. The detection of the range may take place passively, through image processing, or actively, using a laser range finder. The prevention of firing at close ranges may prevent all firing, or may prevent firing at certain body parts.

Finally, the device 100 may optionally include video and/or audio recording capabilities. The recording may, on the one hand, provide evidence of target aggression (which supports the proper use of force by law enforcement) or lack of aggression on the other hand, which can prevent abuse of force by law enforcement officers when they know they are being recorded.

What is claimed is:

1. A system for restricting a firearm to less lethal shooting, comprising:

an image sensor;

at least one non-transitory memory storing commands, and at least one processor that executes the commands to cause the performance of the following steps:

processing images received by the image sensor to detect one or more potential targets within a scene;

locking on to and tracking at least one of said potential targets;

defining a safety line relative to the scene, wherein the safety line is generated by identifying a lower bound and an upper bound of the target, calculating the height of the target according to said identified lower and upper bound, and setting the safety line at or below a predefined percentage of the height of the at least one locked-on target relative to a total height of the at least one locked-on target;

defining one or more aiming regions on the at least one locked-on target below the safety line; and controlling discharge of the firearm, so as to permit discharge of the firearm when a projectile discharged from the firearm will impact the scene or the target at one of the defined aiming regions, and to prevent discharge of the firearm when a projectile discharged from the firearm will impact the scene or target outside one of the defined aiming regions.

2. The system of claim 1, wherein the processor defines the safety line as a horizontal line relative to the scene.

3. The system of claim 1, wherein the processor is configured to define the safety line automatically during or following locking onto the at least one target.

4. The system of claim 1, wherein the predefined percentage is set according to a type of ammunition that is to be fired on the at least one locked-on target.

5. The system of claim 3, wherein the processor is further configured to identify one or more body parts of the at least one locked-on target, and to define the safety line so as to permit impact only on certain identified body parts.

6. The system of claim 1, wherein the processor is configured to define the safety line according to a user command.

7. The system of claim 6, wherein the user command is a selection of a height relative to the scene; and the processor is configured to define the safety line as a lower of (1) the selected height; and (2) a predefined percentage of the height of the at least one locked-on target relative to a total height of the at least one locked-on target.

8. The system of claim 7, wherein, when the selected height is below the at least one locked-on target, a projectile discharged from the firearm is allowed to impact the scene only in front of the at least one locked-on target.

9. The system of claim 1, wherein, when the processor detects an approach of the at least one locked-on target to the firearm, the processor lowers the safety line relative to the scene while maintaining the safety line at a same height on the at least one locked-on target.

10. The system of claim 1, wherein the processor is configured to define the one or more aiming regions taking into account the size and shape of the target, ballistics of the firearm, wind speed, moving speed of the at least one target, and range to the target.

11. The system of claim 1, wherein, following locking onto the at least one target, the processor is further configured to prevent discharge of the firearm upon detection of entry of a non-target or another of the one or more potential targets into the one or more aiming regions.

12. The system of claim 1, wherein the processor is further configured to detect a range to the locked-on target and to prevent discharge of the firearm within a predetermined distance from the locked-on target.

13. The system of claim 1, further comprising the firearm, wherein the firearm is either handheld, or part of a weapon system installed on a remote-controlled weapon station, a robot, or a drone.

14. A method of restricting a firearm to less lethal shooting, comprising:

processing images received by an image sensor to detect one or more potential targets within a scene;

locking onto and tracking at least one of said potential targets;

defining a safety line relative to the scene, wherein the safety line is generated by identifying a lower bound and an upper bound of the target, calculating the height of the target according to said identified lower and upper bound, and setting the safety line at or below a predefined percentage of the height of the at least one locked-on target relative to a total height of the at least one locked-on target;

defining one or more aiming regions on the at least one locked-on target below the safety line; and controlling discharge of the firearm, so as to permit discharge of the firearm when a projectile discharged from the firearm will impact the scene or the target at one of the defined aiming regions, and to prevent discharge of the firearm when a projectile discharged from the firearm will impact the scene or target outside one of the defined aiming regions.

15. The method of claim 14, further comprising defining the safety line as a horizontal line relative to the scene.

16. The method of claim 14, further comprising defining the safety line automatically during or following locking onto the at least one target.

17. The method of claim 14, further comprising setting the predefined percentage according to a type of ammunition that is to be fired on the at least one locked-on target.

18. The method of claim 14, further comprising identifying one or more body parts of the at least one locked-on target, and defining the safety line so as to permit impact only on certain identified body parts.

19. The method of claim 14, further comprising defining the safety line according to a user command.

20. The method of claim 19, wherein the user command is a selection of a height relative to the scene; and the step of defining the safety line comprises defining the safety line as a lower of (1) the selected height and (2) a predefined percentage of the height of the at least one locked-on target relative to a total height of the at least one locked-on target.

21. The method of claim 20, wherein, when the selected height is below the at least one locked-on target, a projectile discharged from the firearm is allowed to impact the scene only in front of the at least one locked-on target.

22. The method of claim 14, further comprising, upon detection of an approach of the at least one locked-on target to the firearm, lowering the safety line relative to the scene while maintaining the safety line at a same height on the at least one locked-on target.

23. The method of claim 14, wherein the step of defining the one or more aiming regions is performed taking into account the size and shape of the target, ballistics of the firearm, wind speed, moving speed of the at least one target, and range to the target.

24. The method of claim 23, further comprising, following locking onto the at least one target, preventing discharge of the firearm upon detection of entry of another of the one or more potential targets into the one or more aiming regions.

25. The method of claim 14, further comprising detecting a range to the at least one locked-on target and preventing discharge of the firearm within a predetermined distance from the at least one locked-on target.

* * * * *